United States Patent [19]

Hofmann et al.

[11] 4,274,360

[45] Jun. 23, 1981

[54] APPARATUS FOR REGENERATING USED FOUNDRY SAND

[75] Inventors: Franz Hofmann, Neuhausen; Franz Satmer, Schaffhausen, both of Switzerland

[73] Assignee: Georg Fischer Aktiengesellschaft, Switzerland

[21] Appl. No.: 26,891

[22] Filed: Apr. 4, 1979

[30] Foreign Application Priority Data

Apr. 14, 1978 [CH] Switzerland ..... 4011/78

[51] Int. Cl.[3] ..... B05C 5/00

[52] U.S. Cl. ..... 118/303; 241/DIG. 10

[58] Field of Search ..... 118/303, 418, 608, 610; 241/DIG. 10, 275; 51/164.1; 366/220, 221, 222, 223, 224

[56] References Cited

U.S. PATENT DOCUMENTS

| | | | |
|---|---|---|---|
| 1,907,888 | 5/1933 | Spikerman | 241/DIG. 10 |
| 2,274,502 | 2/1942 | Piper | 241/DIG. 10 |
| 2,601,355 | 6/1952 | Wyss et al. | 118/303 X |
| 3,285,223 | 11/1966 | Sahlen | 118/303 X |
| 4,004,942 | 1/1977 | Richard | 241/DIG. 10 |

FOREIGN PATENT DOCUMENTS

| | | |
|---|---|---|
| 2252217 | 5/1974 | Fed. Rep. of Germany . |
| 2252259 | 5/1974 | Fed. Rep. of Germany . |

*Primary Examiner*—John P. McIntosh

*Attorney, Agent, or Firm*—Roylance, Abrams, Berdo & Farley

[57] ABSTRACT

Regeneration of clay-bonded used foundry sand for reuse instead of new sand. A dry mass of used sand is rubbed for such a length of time, is accelerated suddenly and delayed, and is freed continuously of fine components, until the fine matter, active bonding clay and oolitization degree fall below certain threshold values such that the regenerated product substantially gains the characteristics of new sand. An apparatus for regeneration treatment contains a horizontal revolving sand drum (10), an impact rotor (30) disposed inside said drum in the area of the fall stream (46) of the used sand and a pneumatic dust removal device (36) disposed in the inside of the drum. A chemical secondary treatment of the regenerated product can be carried out advantageously in the same installation in order to bind remaining fine matter to the surface of the grains of sand and simultaneously to seal the pores of the grains.

3 Claims, 2 Drawing Figures

APPARATUS FOR REGENERATING USED FOUNDRY SAND

Figure 1:
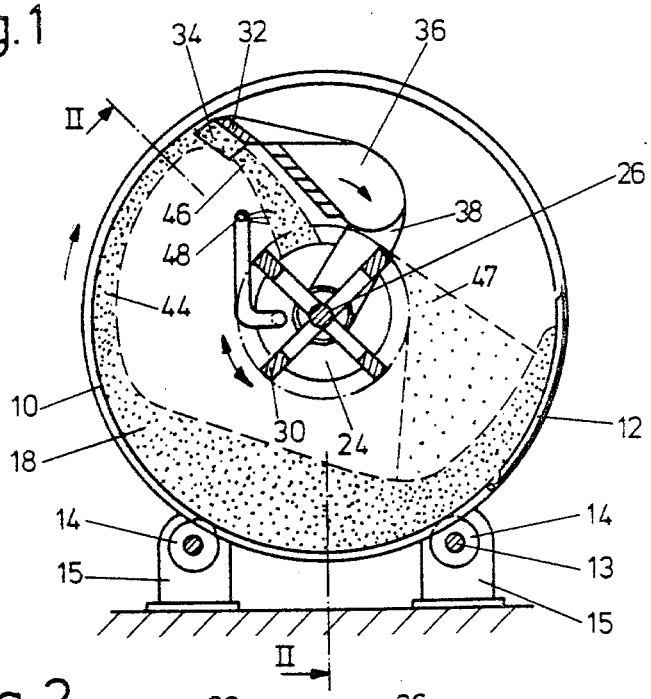

This invention relates to a process for the regeneration of primarily clay-bonded used foundry sand to prepare the sand for reuse instead of new sand by means of mechanical separation of portions of the binding substances from the granulated basic mass. The invention also relates to apparatus suitable for carrying out the regeneration treatment and to regenerated foundry sand as a product of the treatment.

BACKGROUND OF THE INVENTION

It is customary, in the circulation of the molding sand of a foundry using clay-bonded, green-molded casting sand, for the largest part of the used sand obtained at the place of mold unpacking to be fed through a processing installation for reuse in the green-sand molding. This used sand is a mixture of primarily clay-bound molding sand and smaller quantities of chemically bound core sand which had been introduced into circulation for the first time as new sand by way of the core-making installation. The used sand regularly contains still active bonding clay (bentonite) as well as carbonaceous residues, especially coked, porous coal dust. In addition, the grains of sand are increasingly changed in a system involving repeated circulation because a part of the bonding clay is burned dead (calcined) as a result of the heat action of the casting metal, and adheres as a ceramic, porous surface layer on the grains of quartz, a phenomenon referred to as oolitization.

The above-mentioned processing takes these circumstances into account in the return of the used sand. The active bentonite contained in the used sand is made bondable again with the addition of new bonding clay and water. Oolitization and coal dust have favorable effects on the characteristics of the molding substance up to a certain degree.

However, not all of the used sand can be reused in this manner. New quartz sand is introduced continuously into the system predominantly by its initial use in the core shop. Used sand must be separated out to a corresponding degree (apart from uncontrollable losses) because the requirement for clay-bonded molding sand remains, on the average, rather constant. The hauling away and the disposition of this quantity of used sand (waste sand) causes considerable expense and is also a burden on the environment.

It would therefore be desirable to be able to use such used sand instead of new sand. However, this has not been possible because of the significant deviation in the nature of the used sand from the new sand as described above: active, mostly basic bentonite is incompatible with practically all of the chemically setting binding systems used in core production. In addition, and because of the porosity of the oolitic shells of the grains and of the carbonaceous granules as well as because of the high fine particulate matter (also known as fines or AFS clay) content, the consumption of liquid chemical binders would be much too high. It is therefore quite clear that regeneration of the used sand for reuse with chemical binders in the core shop is much more difficult than the previously mentioned customary processing with binder clay and water. Thus, in order that the used sand can be channeled into reuse replacing new sand, it will be necessary to regenerate it in a manner which imparts to it largely the properties of new quartz sand.

A washing process, for example, which merely removes the "fines" will, as a rule, not achieve the goal.

A proposed regeneration process is described in German Offenlegungsschriften 22 52 217 and 22 52 259 wherein used sand is first reduced to grain size, and it is then calcined at a temperature of between about 550° and 1,300° C., and, finally, it is subjected to a cleaning of the grains by mechanical and/or pneumatic rubbing together of the grains. This, however, requires a considerable expenditure in machine installations through which the material must pass in sequence. Furthermore, the energy requirement is considerable, particularly for the annealing. It is moreover questionable whether even after the preceding annealing treatment, the casings of clay firmly burnt onto the grains will be sufficiently removed by rubbing.

BRIEF DESCRIPTION OF THE INVENTION

An object of the present invention is to provide an effective and economic regeneration of used sand so that both the physical and technical conditions for use of the regenerated product in place of new sand are satisfied and savings are achieved by greatly reduced need for new sand and also elimination of the costs for disposal of the used sand.

The invention includes a process for regenerating used foundry sand which is predominantly clay-bonded used sand to permit reuse thereof in place of new sand by mechanical separation of portions of the binding substance from the granular basic mass comprising the steps of causing a batch of granules and nodules of the dry mass of used sand to rub against each other, repeatedly suddenly accelerating and decelerating portions of the batch, and continuously extracting from the batch fine portions of separated materials until predetermined contents of fine particulate materials and active bonding clay and until a desired degree of oolitization of the grains are achieved.

In another aspect, the invention includes an apparatus for the regeneration treatment of used predominantly clay-bonded foundry sand for use instead of new sand comprising a drum for receiving a quantity of used sand for processing, means for mounting the drum for rotation about a horizontal axis, rotating impact tool means mounted within said drum for repeatedly contacting and accelerating sand dropping from an upper portion of the interior of the drum, and pneumatic dust removal means mounted within the drum and including conduit means extending out of the drum for removing the fine material therefrom.

The invention further includes regenerated used foundry sand including fine particulate matter content of less than 2%, and active binder clay content of less than 1% and having a degree of oolitization of the sand grains of less than 8% and a loss on ignition of less than 1.5%.

Figure 2:
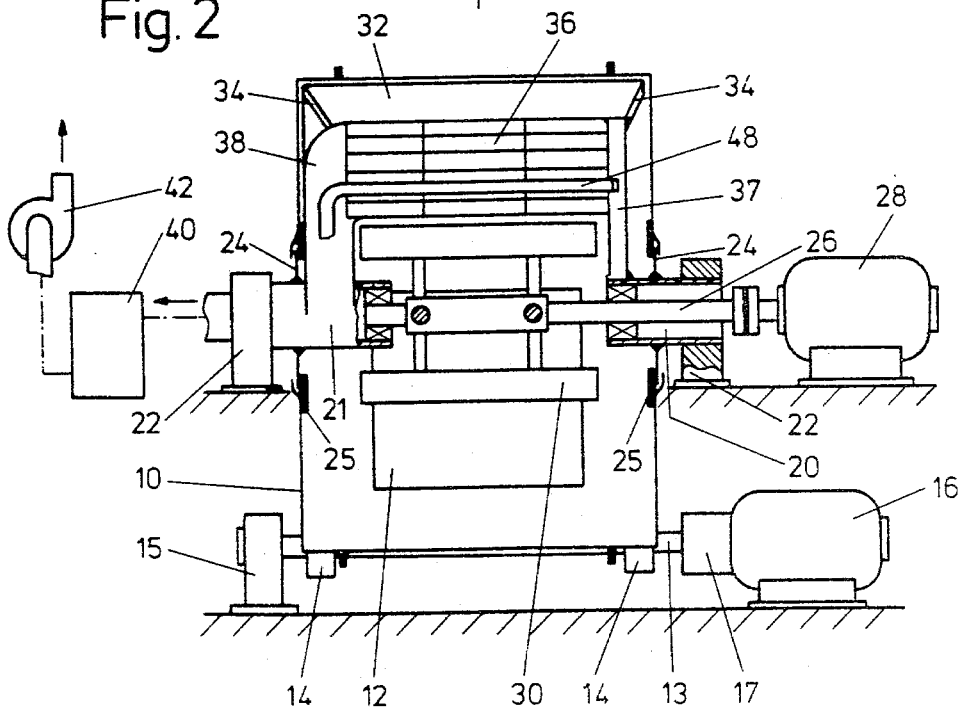

In order that the manner in which the foregoing and other objects are attained in accordance with the invention can be understood in detail, particularly advantageous embodiments thereof will be described with reference to the accompanying drawings, which form a part of the specification and wherein:

FIG. 1 is a vertical end elevation, in section, through a drum arrangement for sand regeneration in accordance with the invention; and FIG. 2 is a front elevation along line II—II of FIG. 1.

As will be recognized from the following description, the combined impact and rubbing or scrubbing treatment with simultaneous dust removal can advantageously be carried out in a single machine without repeated refilling of the sand into various assemblies. Also, special comminution of the nodules need not precede the processing described herein, nor is an annealing treatment necessary. The process must be accomplished by charges or batches, a continuous method of operation not being expected to yield good results.

It may be effective to subject the sand to a chemical after-treatment, after the mechanical treatment has been carried out, to bind the residual fine portions of the surface to the cleaned grains of sand and, at the same time, to also seal the micropores of the grains. Such an after treatment can advantageously be carried out in the same apparatus.

The combined impact and rubbing treatment with simultaneous dust removal of a dry batch of sand during a sufficient interval of time is essential for the success of the regenerating treatment. The nodules present in the used sand are quickly broken up by the impact treatment. As a result of the dry rubbing, the relatively soft fine material (defined as being removable by the clay wash test) present in a dry and bonded form, as well as soft grains of carbonaceous components, are rubbed into powder so that these portions can be separated from the compact grains of sand and carried away be means of air separation. Subsequently, the repeated intensive acceleration, delay and rubbing or scrubbing causes a grinding down of the brittle, firmly burnt clay casings on the grains of sand. The rubbing in connection with the oolitization furthermore causes a desirable rounding off of previously edgy grains of sand. It is important that the separating out of the fine particulate matter and of the continuously produced dust takes place continuously since, during the mechanical treatment, the yield of such powdery components is great and too high a portion thereof in the mass of sand would dampen the impact and rubbing stresses.

It has been found that the above-mentioned threshold conditions in the nature of the regenerated used sand constitutes the minimum conditions for the successful reuse of the regenerated material instead of new sand, the conditions being as follows:

(a) less than 2% fines (i.e., portions less than 20 microns removable by the clay wash test) by weight;

(b) less than 1% active bonding clay by weight; and (c) less than 8% in the degree of oolitization of the grains.

With these characteristics, the customary chemical binders will not be impeded in their effectiveness, and their consumption will remain within economically bearable limits. It should be noted that the oolitization degree is defined as the portion of the oolitic bonding clay encasings, dead burnt, and fixed on the grains of sand, related to the washed portion of the sand bigger than 20 microns and calcined at 900° C.

In certain cases, it may be effective to determine a limiting condition based primarily on the coal dust even for the annealing loss and to extend the regenerating treatment for such a length of time until the latter amounts to less than 1.5% in the used sand.

The required duration of treatment until the above-mentioned threshold conditions are reached will be variable depending upon the pertinent conditions existing in the sand system initially and may be determined by simple experiments. During the treatment, as a rule, it is natural to expect that not all of these border or threshold values will be reached simultaneously. The treatment expenditure may be decreased in some cases, for example, by terminating the mechanical treatment including impact and rubbing and continuing the separating out of the fine portions (the dust removal). In some cases, a further reduction of the content of fine particulate material and binder clay may bring advantages beyond the limits stated for the reuse and especially in regard to binder requirements. To be sure, with purely dry dust removal as by air separation, this calls for an increasing expenditure in the sense of a disproportionate extension of the treatment. Chemical secondary treatment succeeding the dry regeneration may then be more effective, because not only the fine portions are completely bonded on to the surfaces of the grains, but also the micropores of the grains of the sand and of the oolitic residues of the encasings are sealed.

In this manner, used sand may be regenerated to an extent that it differs only immaterially in composition and structure from good new sand. As a measure for the consumption of binder which is to be observed from the economic point of view and also from the point of view of application techniques, the requirement of linseed oil will be determined effectively as in the case of new sand. This is the quantity of addition of linseed oil to a sample of sand which is required in order to achieve a compression strength of 100 kilograms per centimeter ($kg/cm^2$) with standard testing bodies, which had been treated in a furnace for two hours at 230° C. and has been cooled subsequently in an exsiccator. The best quartz sands have a linseed oil requirement of about 1.1 to 1.5% and the values achieved in the case of regenerated used sands in comparison therewith allow one to judge the profitability of the regenerating treatment.

Active bentonite is fairly strongly hygroscopic and absorbs 10–15% of moisture from the atmosphere at room temperature, as a result of which absorption it assumes a soap-like to greasy state. In the warm, dry state, on the other hand, it is hard and brittle and as a result it may be rubbed easily. Therefore, a sufficient dryness of the material to be treated constitutes a presupposition for the successful regenerating treatment, especially for the thorough dust removal. This is assured, generally, at a used sand temperature of about 50°–150° C. at the beginning of processing. In such a case, the pouring heat from the previous use of the sand may be employed advantageously. Otherwise, and especially whenever an extended period of time has lapsed between the unpacking and regeneration, a preheating of the charges of used sand to the above-mentioned range of temperatures will be effective, the preheating taking place, however, to preferably less than 100° C. It has been observed, however, that during the processing the sand is heated automatically as a result of the rubbing through the generation of frictional heat.

The regenerated used sand is used as a rule mixed with a portion of new sand and, particularly in the case of core production, it is used with chemically solidifying inorganic or organic binders. In the normal case, the regenerated product is naturally used again in the same installation where the used sand is obtained. However, depending upon the economic conditions, it is conceivable that the sand could be transferred to some other installation. As has been mentioned, in addition to the cost and suitable sources of securing new sand, the costs and activities of the elimination of waste sand as well as environmental problems may also be important reasons for the regeneration of used sand. As a product, the regenerated sand, because of the not completely eliminated state of the used sand, and above all because of the residual oolitization, may also have more overall favorable characteristics from the point of view of pouring techniques in comparison to new quartz sand such as, for example, a reduced tendency for expansion defects, hot tears and burn-on. For this purpose, a strongly reduced porosity of the grain and a fixed shell on the surface of the grain of residual fine portions are to be numbered among the results of a possible chemical after-treatment.

The following example will provide a concrete embodiment of the regenerating process in accordance with the invention.

The following table illustrate the effect of the described regenerating treatment in the case of two kinds of used sand A and B from different foundries. In a regeneration installation, to be described hereinafter, the combined mechanical impact and rubbing treatment with continuous dust removal took place during 15 minutes and, subsequently, the separation of the dust alone was continued for an additional five minutes. After the required minimal conditions had been achieved thereby, an additional secondary chemical treatment took place in the same installation, as a result of which treatment the requirement for linseed oil could again be reduced considerably. In the following table, "V" designates the state prior to the mechanical treatment, and "N" the state after the mechanical treatment, but prior to the secondary chemical treatment.

TABLE

| | | | A Used Sand from Malleable Iron Foundry | B Used Sand from Grey Iron Foundry |
|---|---|---|---|---|
| Content of fines | % | V | 6.9 | 8.4 |
| <20 microns | | N | 1.3 | 1.0 |
| Total | % | V | 1.85 | 5.0 |
| loss on ignition | | N | 0.1 | 0.5 |
| Degree of oolitization | % | V | 16.2 | 10.0 |
| | | N | 8.0 | 2.2 |
| Content of active | % | V | 4.1 | 5.3 |
| bentonite | | N | 0.8 | 0.5 |
| Linseed oil requirement | % | N | 2.4 | 1.3 |
| Chemical secondary treatment: (additions in ml per 100 kg sand) | | | | |
| Phosphoric acid concentration for the preneutralization | | | 60 | — |
| Phenolic resin binder | | | 800 | 250 |
| Paratoluene sulfonic acid | | | 300 | — |
| Linseed oil requirement in % after the chemical secondary treatment | | | 1.35 | 1.1 |
| Linseed oil requirement of the new quartz sand used in % (comparison) | | | 1.1 | 1.25 |

The phenol resin binder used for the secondary treatment in the above examples sets with the added paratoluene sulfonic acid or with acid substances already present in the sand and impregnates the existing pores of the grains of sand and fixates the residual, fine portions on the surface of the sand grains.

As can be seen, in the case of sand B, particularly favorable preconditions exist for the regeneration. It turns out that it would be possible to produce a suitable regenerated sand with even a shorter mechanical treatment and that chemical after-treatment can be omitted.

The chemical after-treatment consists in the fact that the mechanically treated sand is mixed intensively with a quantity of impregnating and fixing liquid corresponding to its water absorption. At the same time, the fine portion is wrapped uniformly around the grains and, after that, is fixated as a smooth encasing and is thus made a solid component of the grain so that it does not mix further with the core binder to be added later on and does not influence the binder chemically and/or physically.

Thus, it is the function of the after-treatment to neutralize the sand, as needed, and to fixate the residual dust and to make it compatible with chemical binders, but also to improve it from the point of view of labor hygiene and safety.

For the treatment, inorganic or organic substances may be used which set either cold or warm. Cold setting systems are preferred for economic reasons. A concentrated phosphoric with an addition of aluminum hydroxide and/or with a succeeding drying of the treated sand at 300°–350° C. come into consideration, and a monoaluminum phosphate solution with an addition of aluminum hydroxide and/or subsequent drying at 300°–350° C. The treatment processes with phosphoric acid and monoaluminum phosphate may also be combined with one another.

Sodium or potassium silicate with subsequent drying of the treated sand can also be considered so that a neutralization effect in the case of acid sand will be achieved additionally. Further considered are cold setting, synthetic resins which set with acids, for example, paratoluene sulfonic acid or phosphoric acid as used in foundries as sand binders, organic adhesives of all types with succeeding air drying or heat drying for the removal of the solvent and inorganic adhesives such as, for example, silicious brine. In many cases, it will be sufficient to fixate the residual particulate matter which remains after the rubbing treatment with a small quantity of water on the grains of sand. This can be accomplished most economically in the drum according to the apparatus of the invention.

Turning now to the apparatus as illustrated in the drawings, it will be seen that the regenerating installation shown operates in a batch-process fashion and includes a cylindrical drum 10 which is preferably mounted with its axis horizontal, the drum being provided with a door 12 for filling and removing a charge or batch 18 of used sand. The drum 10 rests on driving rolls 14, the shafts 13 of which are rotatably mounted in bearing blocks 15 and are driven by a motor 16 through a transmission gear 17. Coaxially with the axis of the drum, two fixed, hollow axles in the form of sections of pipe 20 and 21 are retained in pedestals 22 at opposite ends of the drum. On each pipe section 20 and 21, there is a sheet metal disc 24 attached in the plane of the generally circular end walls of the drum. The two discs 24 substantially fill a corresponding circular opening in each end wall of the drum and the annular gap is bridged with a suitable seal such as, for example, an annular rubber strip 25 which is attached at its inner periphery to its associated disc 24. In the two pipe sections 20 and 21, a shaft 26 is mounted, the shaft being driven at a relatively high rotational speed by a motor 28. An impact tool 30 is mounted on shaft 26 within drum 10, the impact tool having a plurality of impact beams which preferably extend generally parallel with the axis of the drum and which can revolve in the same direction as the drum, but can also run contrary to the drum as indicated by the double arrow in FIG. 1. The contrary motion is preferred.

In the upper region of the drum interior, there is a fixed scraper 32 which extends longitudinally near the inside wall of the drum in parallel to a generatrix and which is provided with lateral guide baffles 34. Between the area of the impact tool 30 and scraper 32 and preferably connected with the scraper, a dust removal device in the form of a suction box 36 is mounted. Scraper 32, suction box 36, a suction pipe extending from the suction box and a radial bridge 37 advantageously form a rigid unit which is firmly attached with the two fixed pipe sections 20 and 21. The suction pipe 38 advantageously leads to the inside of the pipe section 21 which is connected through a filter unit 40 with a blower 42 which produces a suction air current providing the suction at box 36. A possible variation of this apparatus includes the omission of scraper 32 and permitting the sand to simply drop from the upper portion of the drum.

Driving motors 16 and 28, as well as blower 42, may be individually energized or deenergized according to the requirements of the operation. When drum 10 is revolving, a layer of sand 44 is lifted as a result of centrifugal force and inside friction continuously from the dry used sand batch 18 lying in the bottom portion of the drum. The rotational speed of the drum must be such that a carrying upward and forward of the sand is guaranteed. When the layer of sand 44 encounters the scraper 32, it is removed from the interior wall of the drum in a falling stream 46 and is directed downwardly generally toward and across the axis of the drum. The following stream then reaches the area of the impact beams forming a part of the rapidly revolving impact tool 30, and by this device the sand is hurled, in a jet 47, outwardly against the wall of the drum whereupon it is guided downwardly again.

In this way, the mass of used sand is in a continuous circulation in the drum. Upon meeting of the falling stream 46 with the impact tool, the sand experiences a strong sudden acceleration and upon the succeeding impact on the inside wall of the drum, it is suddenly correspondingly decelerated or delayed. This impact stress is continuously repeated since the mass of sand executes a large number of circulations through the process described during the duration of treatment of about one-quarter to one hour. In addition, the mass of sand 18 is rubbed intensively during revolution as a result of the continuous movement of the grains of sand against each other and as a result of friction against the wall of the drum as well as, above all, upon deflection of the layer of sand 44 on the scraper 32 and, in the case of the impact beam striking against a "sand package" from the falling stream 46. The dust accumulating in the case of this mechanical treatment in the mass of sand is separated out continuously by the previously described pneumatic dust removal device and is collected in filter unit 40. Particularly favorable for the effective dust removal is the arrangement of the suction box 36 with the suction openings beside the falling stream 46, as a result of which the air separation is accomplished out of the loosened mass of sand. Replacement air for that extracted by the suction box can enter into the drum by the action of the gaskets 25 acting somewhat in the manner of clack valves and also through pipe section 20, or through a specially provided inlet opening, not shown, which can be in the disc 24.

A treatment apparatus of the type described and given by way of example was constructed with a drum having an inside diameter of one meter and having an impact tool with a diameter of 0.6 meters. When using a speed of revolution of the drum of 0.7 revolutions per second, a peripheral speed of the drum of about 2.2 meters per second which is adequate for the circulation of the sand, and with a rotational speed of the impact tool of 24.7 revolutions per second, there results an impact speed of the impact beams on the sand of about 46 meters per second. This peripheral speed provides a fully adequate strength of impact and acceleration upon striking the sand and subsequently a suitable deceleration of the sand when it impacts against the drum. The peripheral speed should, in any case, amount to at least about 30 meters per second.

As has been previously mentioned, it may be effective to interrupt the drive of the impact tool 30 after a sufficient mechanical impingement of the sand and to continue the dust removal for some time interval thereafter while the drum is still rotating. In experiments conducted in this fashion, less air is removed by suction. Insofar as chemical secondary treatment is subsequently necessary, this treatment may likewise be accomplished in the drum 10. For this purpose, a spray arrangement for the distribution of the treatment liquid in the sand charge may be disposed within the drum, preferably in the form of a jet tube 48 which, as illustrated, is mounted in the area of the falling stream 46. With the help of this spray arrangement, it is possible to distribute the necessary quantity of liquid in a simple manner in the charge 18 of sand while the impact tool 30 is at a standstill and the pneumatic dust removal arrangement is turned off, but while the drum 10 is still revolving. The quantity of liquid as a rule is so small that it will be absorbed completely by the micropores of the grains of sand and the residual portion of the fine particulate material so that the sand remains capable of flowing.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for the regeneration treatment of used predominantly clay-bonded foundry sand for use instead of new sand comprising a drum for receiving a quantity of used sand for processing;

means for mounting said drum for rotation about a horizontal axis;

rotating impact tool means mounted within said drum for repeatedly contacting and accelerating sand dropping from an upper portion of the interior of said drum; and pneumatic dust removal means mounted within said drum adjacent the path of dropping sand between said drum and said impact tool means, said removal means including conduit means extending out of the drum for removing the fine material therefrom.

2. An apparatus according to claim 1 and including a scraper extending along a line parallel with a surface portion of said drum to cause said sand to drop, said scraper including said dust removal means.

3. An apparatus according to claim 1 and further including means within said drum for spraying the used sand with a treatment fluid, said spraying means including a jet tube adjacent the dropping sand.

* * * * *